United States Patent [19]

Cheney

[11] 4,122,614

[45] Oct. 31, 1978

[54] NORDIC SKI TRACK SLED

[76] Inventor: Stanley O. Cheney, Rte. 114 North, Bradford, N.H. 03221

[21] Appl. No.: 781,541

[22] Filed: Mar. 28, 1977

[51] Int. Cl.[2] ..... E01H 4/00

[52] U.S. Cl. ..... 37/10; 37/13; 172/387; 172/394; 280/9; 280/12 M; 37/52

[58] Field of Search ..... 37/10, 13, 51, 52; 404/96; 172/387, 392–394; 280/12 M, 12 R, 13, 26, 28, 8–11, 7.1, 7.12

[56] References Cited

U.S. PATENT DOCUMENTS

| | | | |
|---|---|---|---|
| 1,007,459 | 10/1911 | Larsen | 172/393 |
| 1,111,108 | 9/1914 | Talbot | 172/393 X |
| 1,161,674 | 11/1915 | Holland | 172/393 X |
| 2,705,447 | 4/1955 | Robbins | 172/393 |
| 2,883,204 | 4/1959 | Tomasovich | 280/13 |
| 2,932,525 | 4/1960 | Perry | 280/13 |
| 3,043,034 | 7/1962 | Kober | 37/10 X |
| 3,739,859 | 6/1973 | White | 172/393 X |
| 3,795,069 | 3/1974 | Cheney | 172/393 X |
| 3,815,688 | 6/1974 | Brown | 172/393 X |
| 4,014,116 | 3/1977 | Baechler | 37/10 |

FOREIGN PATENT DOCUMENTS

| | | | |
|---|---|---|---|
| 721,917 | 11/1965 | Canada | 37/13 |
| 24,909 | 9/1918 | Denmark | 172/387 |
| 1,248,085 | 1/1965 | Fed. Rep. of Germany | 172/122 |
| 32,313 | 5/1921 | Norway | 280/13 |
| 427,875 | 1/1967 | Switzerland | 172/387 |

*Primary Examiner*—E.H. Eickholt
*Attorney, Agent, or Firm*—Schiller & Pandiscio

[57] ABSTRACT

A new ski track mold is disclosed which is capable of forming a new and improved type of ski track for use in Nordic skiing when towed behind a tractor, snowmobile or similar transport vehicle. This invention provides novel means for forming a ski track which has a track plane for each ski substantially perpendicular to the earth's gravitational vector forces regardless of the type of terrain being traversed, as well as novel means for assuring a superior quality ski track with an increased life span.

15 Claims, 12 Drawing Figures

NORDIC SKI TRACK SLED

BACKGROUND OF THE INVENTION

A. Field of the Invention

This device relates to Nordic skiing in general and in particular to a new and improved type of ski track sled for use in setting ski tracks in snow for applications in Nordic skiing.

B. Description of the Prior Art

In the past few years the popularity of Nordic, or "crosscountry", skiing has grown enormously. This growth in popularity has subsequently led to renewed interest in developing the equipment used in that sport. Many recent improvements have been made in skis, bindings, boots, poles and other equipment associated with Nordic skiing. Relatively little attention has been turned, however, to the art of molding ski tracks in snow.

In Nordic skiing preforming ski tracks is very desirable on heavily used recreation trails and in particular on courses used for racing. These ski tracks allow the skier to traverse the land without having to continuously "break trail" over virgin snow, thereby lessening skier fatigue and increasing the speed with which terrain can be covered. These ski tracks generally consist of one or more tracks of packed snow wide enough to accommodate a Nordic skier.

Nordic ski tracks are presently formed in a variety of ways. One of the simplest of these is to simply send a snowmobile or similar vehicle across the intended trail ahead of the skiers. This packs down the snow and breaks up ice and hard snow to crudely prepare a single wide track for skiers to follow in. A better way to form the ski track is to send a single skier across the intended trail first. The tracks left by this skier then become the tracks used by subsequent skiers. The lead skier may either traverse the terrain under his own power or may be towed behind a suitable vehicle, such as a snowmobile. The track produced in this manner is usually superior to that formed by simply running a snowmobile across the snow, since it is smoother and clear of the larger chunks of snow or ice often left by the snowmobile. As a general rule, however, even this method for forming Nordic ski tracks yields fairly mediocre results.

The best method developed to date for producing a ski track employs a track sled towed behind a vehicle. This track sled generally consists of a sled fitted with two runners at its base, each runner approximating the width of a typical Nordic ski with bindings attached. Then, as the track sled is pulled through the snow along the desired route, a pair of ruts are left in the snow for skiers to follow in. These twin ruts form the ski track. Various modifications of this basic design have been constructed, such as providing a convenient means for adding to or subtracting from the weight of the sled, as dictated by the various snow conditions which may exist at the time of use.

Unfortunately, even the most advanced of the track sleds presently in use exhibit a number of undesirable characteristics. For example, as the track sled is towed over level ground it tends to produce a ski track with a track plane perpendicular to the earth's radius. Now this is certainly the most desirable plane for the ski track, since it allows the skier to stand perfectly aligned with the earth's gravitational vector forces which pull down on the skier, thus affording the skier maximum stability. But as the track sled is drawn along the side of a hill, it tends to produce a ski track with a track plane nearly parallel to the slope of the hill itself, i.e., a ski track with a track plane for each ski which deviates from the most desirable track plane — lying perpendicular to the earth's radius. The greater the hill's slope, the greater the deviation from the most desirable track plane. This deviation means that the skier will not naturally tend to stand aligned with the earth's gravitational vector forces which pull down on him. This costs the skier stability when traversing the side of a slope and consequently makes skiing much more difficult as well as more fatiguing and time-consuming. Ideally, the track sled should produce a ski track which has a track plane for each ski substantially perpendicular to the earth's gravitational vector forces regardless of the terrain so as to ensure maximum skier stability. Present track sleds will not do this.

Furthermore, the quality of ski tracks formed by existing track sleds still leaves much to be desired. Some of the problems which have been noted are hereinafter described. First, such tracks tend to crumble quickly under use. Second, these tracks have little protection against drifting snow. The drifting snow easily finds its way into the tracks and eventually renders them useless. Third, the tracks have poor edges which erode quickly due to the wind. Fourth, these tracks fail to set well in ice or hard snow. Fifth, the tracks often have voids or interruptions in their surfaces. Sixth, such tracks generally require a skier to follow in the ski track shortly after it is formed to pack down any loose snow which might have spilled over the walls of the ski track as the track sled was pulled along. This "ski-in" is required to clear the track of the loose snow before it has a chance to freeze in place and thereby ruin the ski track.

OBJECTS OF THE PRESENT INVENTION

The primary object of the present invention is to provide a track sled which solves or substantially eliminates the aforementioned problems.

Another is to provide a track sled which will form a ski track that has a track plane for each ski which is substantially perpendicular to the earth's gravitational vector forces, regardless of the type of terrain being traversed.

Another is to provide a track sled which has greater trackforming ability in ice and hard snow than existing track sleds.

Another object is to provide a track sled which forms a ski track of a more durable nature and with a more consistent density of molded snow crystal aggregate by utilizing better snow compression techniques.

Another object of the present invention is to provide a means for forming a ski track which has more resistance to the effects of drifting snow.

Another is to provide a track sled which will form a ski track free from voids or interruptions in the track surfaces.

Another is to provide a track sled which will form a ski track with an improved bottom surface to maximize the effects of ski bottom design and no-wax skis and the special waxes often used in Nordic skiing.

Another object of the present invention is to provide a track sled which forms a ski track with a minimum of snow spill-over, thereby reducing the need for a skier to follow in the track soon after formation to "ski-in" the track.

BRIEF DESCRIPTION OF THE DRAWINGS

Still other objects, the nature and many of the attendant advantages of the present invention will become readily apparent in the course of the following detailed description which is to be considered together with the accompanying drawings wherein like numbers refer to like parts and further wherein.

DESCRIPTION OF THE PRESENT INVENTION

Figure 1:
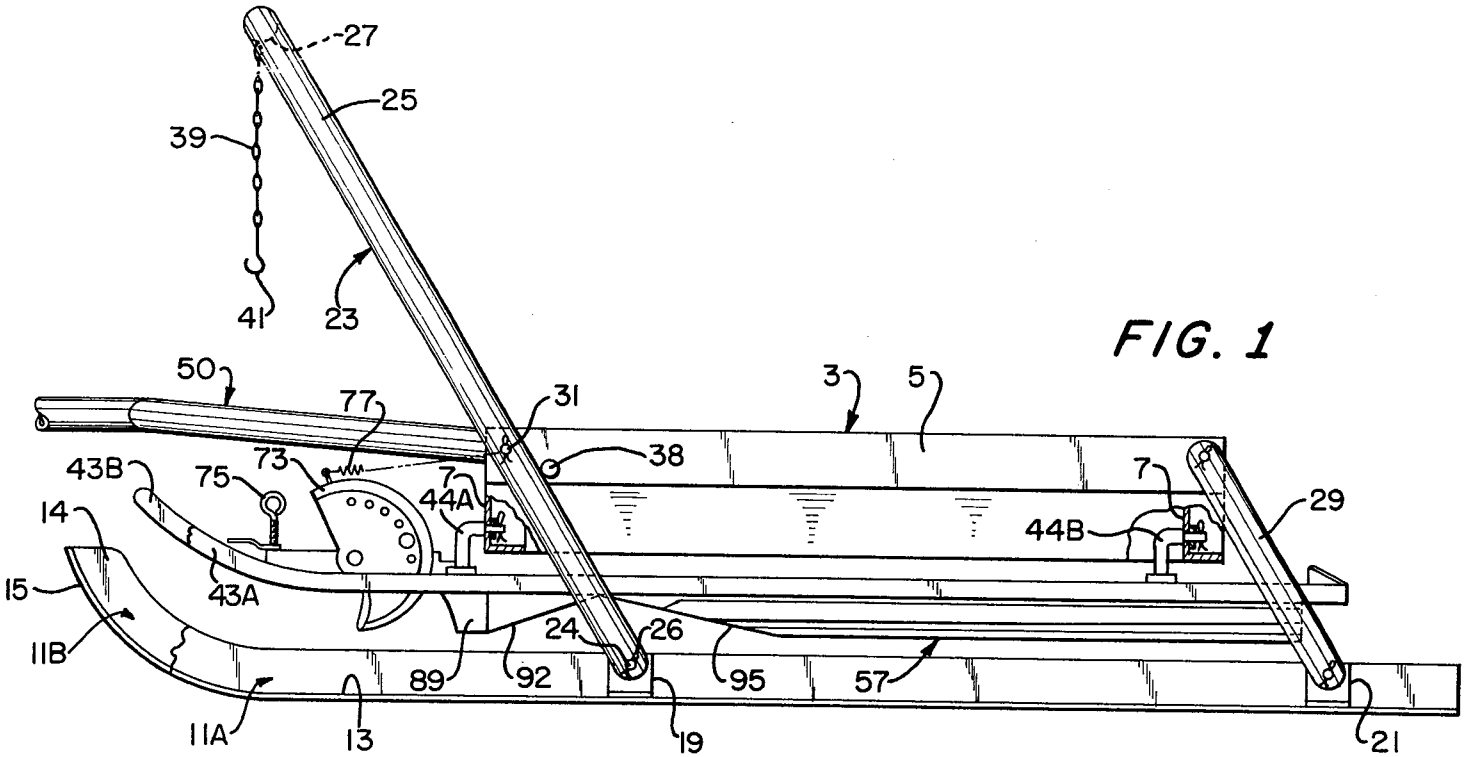
FIG. 1 is a side view in elevation of the preferred embodiment of the track sled in transport mode.
Figure 2:
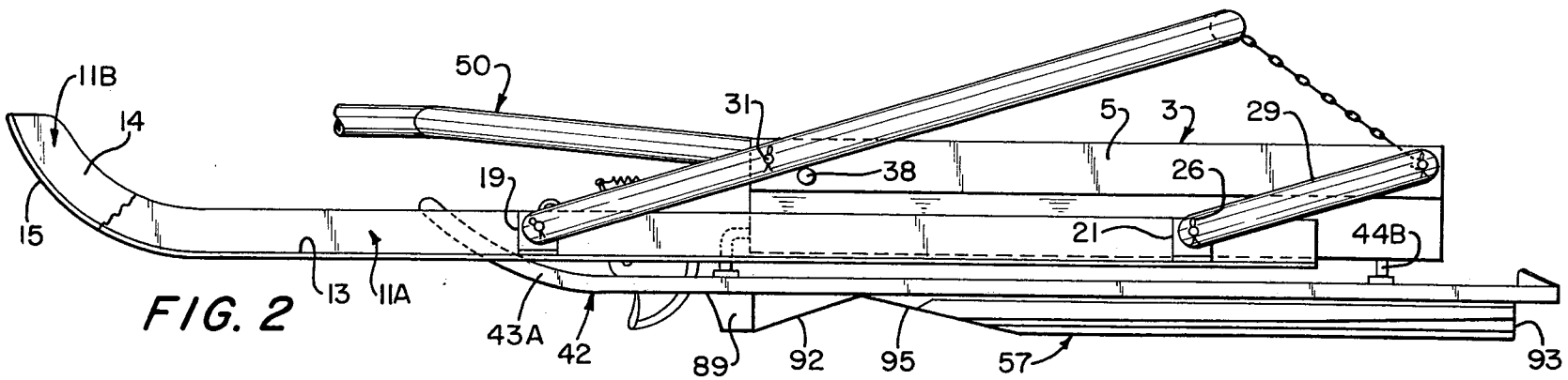
FIG. 2 is a side view in elevation of the preferred embodiment of the track sled in track-molding mode.
Figure 3:
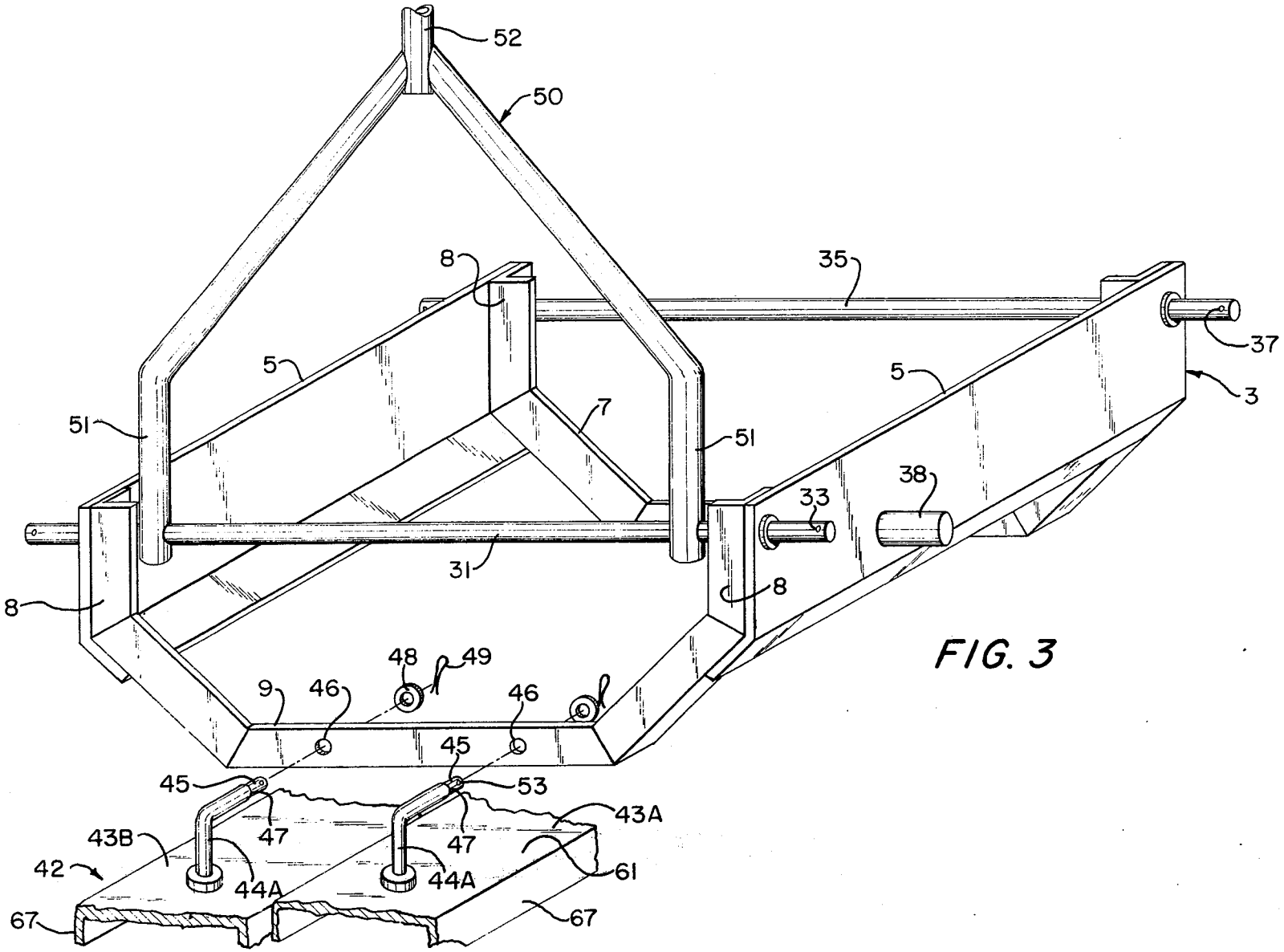
FIG. 3 is a perspective view of the frame of the track sled.

FIGS. 1–3 show a track sled which constitutes a preferred embodiment of the present invention, in transport mode. As may be seen, the track sled is built around a frame 3. This frame occupies a central location in the track sled and serves to give structural support to the working members of the track sled. It is essentially a sled chassis onto which all the other parts of the track sled are hung.

Frame 3 is comprised of two identical bars or plates 5 and two identical, generally U-shaped members 7. Plates 5 lie parallel to one another and are joined near their ends by members 7 in such a way that each U-shaped member 7 extends from the end of one plate 5 to the corresponding end of the other plate 5. Each member 7 has parallel end sections 8 and a body section 9, with the end sections 8 attached to bars 5 so that the body section 9 is below the bars 5. The plane of each member 7 forms a 90° angle with the parallel planes of members 5. Preferably, though not necessarily, members 7 are rigidly joined to plates 5 by means of conventional nuts and bolts or by welding so as to form a rigid open frame.

Lying parallel to and directly below the bars 5 are a pair of parallel and identical transport skis 11A and 11B (FIG. 1). A portion of the transport ski 11A is broken away in FIGS. 1 and 2 and shows the front end of the other ski 11B. Each transport ski is comprised of a long, narrow, horizontally extending base plate 13 and an integral flat web section 14. The base plate 13 has flat top and bottom surfaces and an upturned front 15. Affixed to and rising upwards from each transport ski is a front mount 19 and a rear mount 21. The two transport ski are mounted to frame 3 by means of these mounts and an engagement lever 23 and two support members 29. Engagement lever 23 is essentially an inverted U-shaped tubular member comprising a pair of side arms 25 connected by a transverse section 27. The lower ends of the arms 25 are pivotally attached to the front mounts 19 by suitable conventional means as, for example, by a pivot stud 24 which extends through an opening in a front mount and is held in place by a cotter pin 26. The arm sections 25 of engagement lever 23 are further pivotally secured to a pivot shaft 31 which extends through and is attached to the front ends of the frame members 5. Cotter pins (not shown) received in holes 33 in pivot shaft 31 prevent the arms 25 from being pulled off of the pivot shaft. The support members 29 (only one of which is visible in the drawings) are pivotally attached to the rear mounts 21 by suitable means, e.g. by means of pivot studs 24 and cotter pin 26. These support members also are pivotally attached to the opposite ends of a second pivot shaft 35 which extends through holes in the rear ends of frame members 5. Pivot shaft 35 has holes 37 for receiving cotter pins (not shown) which serve to hold the support members 29 on the opposite ends of the shaft. Support members 29 lie substantially parallel to the arm sections 25 of engagement lever 23 at all times.

In this manner an arrangement is provided such that when engagement lever 23 is moved back and forth on its pivot shaft 31, the height differential between the two transport skis 11 and frame 3 will change. The difference in height will be most extreme when the engagement lever 23 and supports 29 stand exactly perpendicular to the side frame members 5 and the transport skis, and will be least extreme when engagement lever 23 and support members 29 lie as close to parallel as possible with respect to the frame and the transport skis. For this reason, stop means are provided for engagement lever 23 to limit the extent to which the engagement lever can be urged forward. The stop means may take various forms, but preferably the stop means consists of a pair of rods 38 which are affixed to the forward ends of frame members 5 in position to intercept arms 25 of engagement lever when the latter is moved forward or rearward. Rods 38 allow the engagement lever 23 to be moved forward to approximately the 11 o'clock position, so that the weight of the frame and the elements carried thereby will tend to oppose movement of the engagement lever 23 rearwardly from the position of FIG. 1 to the position of FIG. 2. Rods 38 also are positioned to limit the minimum height differential between the frame and the transport skis. As seen in FIG. 2, rods 29 are positioned to intercept the arms 25 of engagement lever 23 when the latter is pivoted rearwardly far enough to cause the track-forming assemblies to be lowered below the level of the transport skis as hereinafter described. The sled is maintained in the position of FIG. 2 by suitable restraining means such as a chain 39 which has a hook 41 which can be releasably engaged with rear pivot shaft 35.

Also attached to the frame 3 are a pair of track-forming assemblies 42 each comprising a flotation ski 43A or B. These two skis are identical and affixed to and extending upward from each of them is a front mounting member 44A and a like rear mounting member 44B. Each of the mounting members 44A and B is essentially a rod which is bent at a right angle and has its bottom end affixed to the flotation ski. The opposite end of each of the members 44A and B is preferably provided with a reduced diameter end section 45 which is sized to loosely pass through a hole 46 in the body section 9 of front or rear frame members 7. The shoulder 47 formed at one end of the reduced diameter section 45 is large enough in diameter to limit the extent of penetration of the rod-like member in body section 9. These mounting members 44A and B are secured to the front and rear U-shaped members 7 by means of washers 48 and cotter pins 49, the latter passing through suitable holes 53 in the mounting members 44. This mode of attachment allows the track-forming assemblies 42 to pivot freely in a side-to-side manner while at the same time rigidly constraining them against longitudinal movement. In this way a sled is constructed that allows both of the track-forming assemblies to track substantially perpendicular to the earth's radius regardless of the slope of the terrain. It should be noted also that this mode of attachment fixes the height of the track-forming assemblies relative to the height of the frame 3, so that when the engagement lever 23 is operated to move the frame up and down in relation to the transport skis 11, it also raises and lowers the two track-forming assemblies 42 relative to the transport skis. When the engagement lever 23 has been moved to its forward limit position, the track-forming assemblies 42 are significantly higher than the transport skis 11. Correspondingly, when the engagement lever 23 is moved rearwardly to the extent permitted by rods 38, the track-forming assemblies will be significantly lower than the transport skis, as shown in FIG. 2.

Thus, when the track sled is in the transport mode shown in FIG. 1, engagement lever 25 will be as far forward as possible so that the track sled will be supported by transport skis 11 with the track-forming assemblies 42 fully withdrawn from the snow. Conversely, when the track sled is in the track-forming mode shown in FIG. 2, engagement lever 25 will be drawn back as far as possible so that the track sled will be supported entirely by the track-forming assemblies 42 with transport skis 11 fully withdrawn from the snow. The engagement lever 25 may either be operated by hand or by means of suitable motor assembly (not shown).

The track sled is intended to be dragged through the snow by a suitable transport vehicle such as a tractor or snowmobile. For this purpose a towing member 50 is provided. Towing member 50 is essentially a Y-shaped hitch, with the ends of its two legs 51 being rotatably attached to pivot shaft 31 and its third end 52 being pivotally attached to the transport vehicle (not shown). The pivot connections between towing member 50 and the track sled and transport vehicle allow for easy operation on uneven terrain.

While being towed across snow to the trail site and while traversing snow where no ski track is desired, the track sled is intended to be operated in the transport mode shown in FIG. 1. This allows only the transport skis 11 to make contact with the snow and leaves relatively wide and shallow marks in the snow. When running over trail where Nordic ski tracks are desired, however, the sled is operated in the tracking mode shown in FIG. 2. This allows only the track-forming assemblies 42 to make contact with the snow and leaves a new and improved type of Nordic ski track along the terrain.

Figure 4:
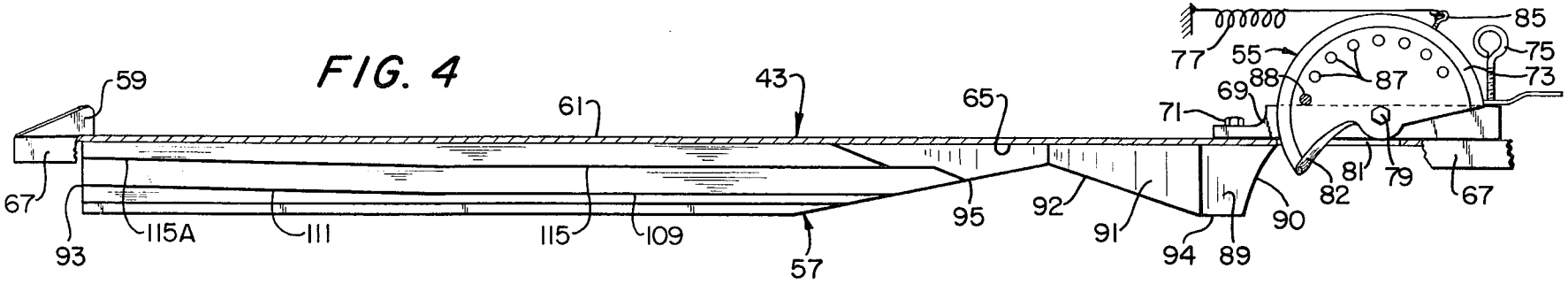
FIG. 4 is a side view in elevation, with a portion broken away, of the preferred embodiment of a track-forming assembly.

The two track-forming assemblies 42 are identical and one of them is shown in greater detail in FIGS. 4–10. Referring first to FIG. 4, it may be seen that in addition to flotation ski 43 each track-forming assembly is comprised of an ice shear assembly 55, a snow mold 57 and a rear fin 59.

Flotation skis 43 are comprised of a long, thin plate 61 having flat top and bottom surfaces and an upturned front to facilitate movement through the snow. Additionally each ski 43 is equipped with a pair of ski edge compression fins 67 for tracking ability and to aid in snow compression. Fins 67 are preferably formed as an integral extension of ski 43. Each flotation ski 43 serves both as a mounting platform for an ice (or hard-packed snow) shear assembly 55, a snow mold 57 and a rear fin 59 and also as a ski to buoy snow mold 57 near the surface of the snow so as to prevent it from burrowing down into the snow and thus incapacitating the track sled. Ski edge compression fins 67 extend lengthwise of the flotation skis and depend from the flat bottom surface 65 at the ski. Fins 67 guide the flotation skis 43 and help keep them in a straight line behind the towing transport when the track-forming assemblies 42 are deployed in the tracking mode, thereby assuring more linear ski tracks.

Each ice shear assembly 55 is mounted near the front of a flotation ski 43 and is designed to break up any ice or hard snow which may lie along the intended path of the ski track before it is encountered by the snow mold 57. Each ice shear assembly 55 comprises a mount 69, a pair of ice shears 73, an adjustment screw 75 and a pair of tension springs 77. Mount 69 is a plate which has one end bolted as at 71 to the flotation ski 43, and ice shears 73 are in turn rotatably mounted on a shaft 79 which is carried by mount 69 and is held in place by a nut 80. The ice shears 73 extend downward through a pair of slots 81 formed in the flotation ski so as to contact any objects passing immediately below the ski. Each ice shear 73 has the general shape of one half of a circular disk and is formed with a curved concave cutting edge 82 to facilitate the shearing action of the shear through ice and hard snow and to increase the velocity of the snow crystal. Furthermore, tension springs 77 are used to maintain the penetration of each ice shear 73 through slots 81 despite the fact that the shears are rotatable on shaft 79 and tend to rotate back up into the slots in reaction to the impact of objects striking cutting edge 82. Each tension spring 77 is attached to pivot shaft 31 and to an ice shear 73 at 85, and is of such nature that it holds the ice shear firmly extended below flotation ski 53 so long as cutting edge 82 encounters objects of sufficiently small size to work without risk of damage. Should an obstacle of ice, stone, wood, etc. be encountered which does not yield easily to a cutting edge 82, tension springs 77 will stretch sufficiently to allow one or both ice shears 73 to yield (by clockwise movement as seen in FIG. 4) out of the way of the obstacle and thereby prevent damage to the ice shear assembly. Once ice shear 73 passes over the obstacle, tension spring 77 returns ice shear 73 to its previous shearing position. Additionally, a series of holes 87 are provided in each ice shear 73 to allow fixing the maximum penetration depth of cutting edge 82. When a sufficiently long pin 88 is inserted through corresponding ones of the holes 87 in the two shears over the mount 69 (or through the mount 69), the pin will serve as a stop by coaction with the upper surface of mount 69 to effectively limit the portion of each ice shear 73 which penetrates the surface of the snow. Furthermore, an adjustment screw 75 is provided to further alter the penetration of ice shears 73. This is done by raising and lowering the front of mount 69 relative to flotation ski 53 by means of adjustment screw 75 which in turn raises and lowers the level of ice shears 73. Screw 75 is received by a threaded hole in mount 69 and has its bottom end in engagement with the upper surface of the ski. The bolt connection at 71 of mount 69 to the flotation ski is such as to permit a limited degree of displacement between the opposite end of the mount and the ski by operation of screw 75.

Snow mold 57 is mounted to the bottom of flotation ski 43 on botton surface 65 just behind where slits 81 penetrate the ski. Snow mold 57 is aligned with the center line of the ski and comprises a front plow 89, a trailing block 91 and a main mold 93, as may be clearly seen in FIGS. 4 and 5. Front plow 89, led by a curved front edge 90, assists ice shears 73 in breaking up ice and hard snow and further serves to mix these with softer snow to form a snow crystal aggregate. This aggregate is forced off to the side by front plow 89. Then trailing block 91, by nature of its upwardly sloping bottom surface 92, creates a void in the snow which refills with the snow crystal aggregate and thereby aids redistribution of the snow crystals. This places the light, airfilled snow crystal aggregate directly in the path of main mold 93, which then utilizes this material and surrounding snow and ice to form the desired ski track. It is to be noted that the bottom surface 94 of plow 89 is flat and extends substantially parallel to the supporting ski.

Main mold 93 consists of a long block shaped with a plurality of surfaces and edges which are intended to mold and control the distribution of the snow crystal aggregate flowing past trailing block 91 into a superior ski track having a predetermined shape. Referring to FIG. 4, we can see main mold 93 has a forwardly inclined surface 95 at the front which encounters the snow crystal aggregate first. This surface 95 forces the snow crystal aggregate into a more compressed state to facilitate the molding performed by the trailing portion of main mold 93. This is needed because the snow crystal aggregate coming off trailing block 91 is very loose and unpacked, making it extremely difficult to mold in that condition. Once surface 95 recompresses the snow crystal aggregate slightly the aggregate forms an excellent molding material which is then encountered by the remainder of main mold 93.

As shown in FIGS. 4, 5 and 8–10, rearwardly of front surface 95 the opposite sides of the main mold are stepped as hereinafter described and the main mold has a concave bottom surface 97 which is centered between its stepped sides. The concave bottom surface 97 is designed to impart a convex surface to the base of the ski track. By forming a base with a convex surface better contact is assured between the ski track and ski bottom. At each side of the concave bottom the mold has flat bottom surfaces 101 which help form the base of the ski track by setting a pair of grooves in the base of the track along the edge of the concave surface. These can accommodate any stray snow which may enter the ski track so as to render it harmless, thus assuring greater track life and superior track performance. A pair of horizontal surfaces 99 begin at inclined surface 95 and run along the length of the mold to slightly behind where surfaces 101 begin, gradually tapering in width. A vertical wall 103 joins each horizontal surface 99 with convex surface 97 up to where the horizontal surface 99 disappears, then becoming a vertical side wall 105. Surfaces 99 and side walls 103 and 105 serve to compress and form a pair of bottom side walls running upwards from the ski track base. These side walls are just high enough and wide enough to accommodate a typical Nordic ski.

Falling off from horizontal surfaces 99 and vertical walls 105 are a pair of surfaces 107 set at approximately 135° angles from vertical walls 105. These in turn contact a pair of surfaces 109 which make an angle of about 75° with vertical wall 105. Surfaces 109 alter their plane at lines 110, becoming surfaces 111 which are horizontal, i.e., at a right angle to surfaces 105. The distance between the outer edge of one surface 111 to the outer edge of the outer surface 111 is just wide enough to accommodate the width of a standard pair of Nordic ski bindings and ski boots.

Falling off from these outer edges of surfaces 111 are a pair of tapered side walls 113. These extend from the very rear of the main mold up to inclined surface 95, and are angled 15° off vertical. Meeting these are a pair of narrow surfaces 115. These in turn lead to tapered side walls 117. Tapered side walls 117 are parallel to tapered side walls 113. Surfaces 115 are parallel to surfaces 109 at their front ends, but alter their planes along lines (not shown) approximating lines 110, and become surfaces 115A (FIGS. 4 and 10) which are shaped like and extend horizontally parallel to surface 111.

Figure 5:
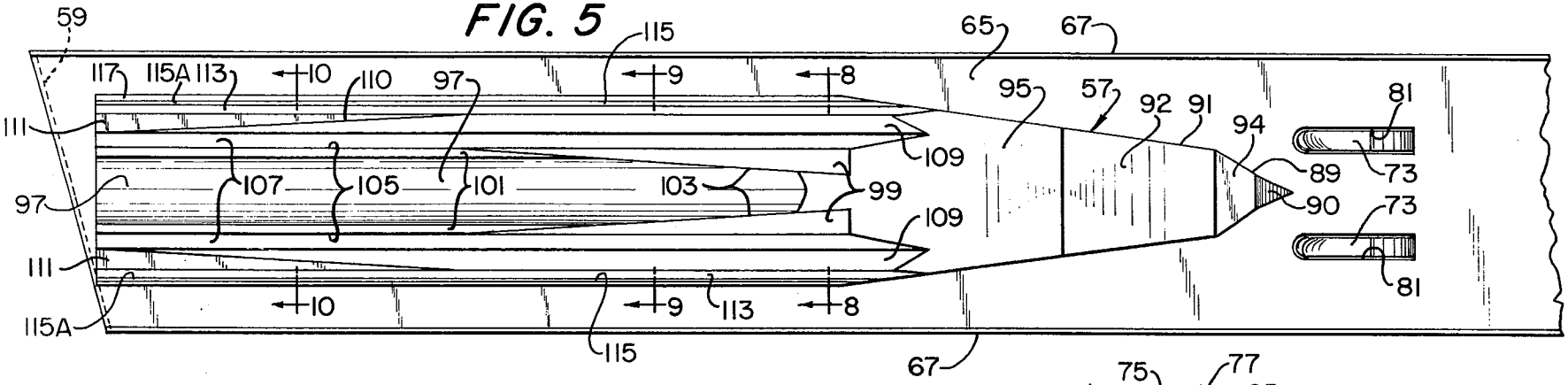
FIG. 5 is a bottom view of the same track-molding assembly.
Figure 7:
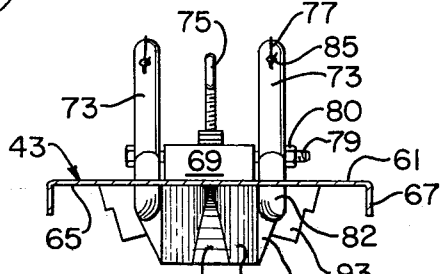
FIG. 7 is a front view in elevation of the preferred embodiment of a track-molding assembly.
Figure 6:
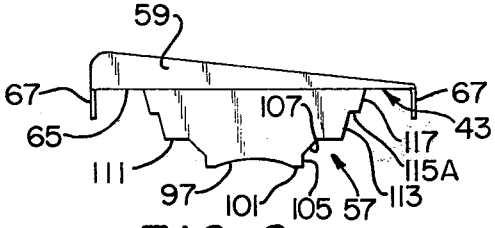
FIG. 6 is a rear view in elevation of the same track-molding assembly.
Figure 8:
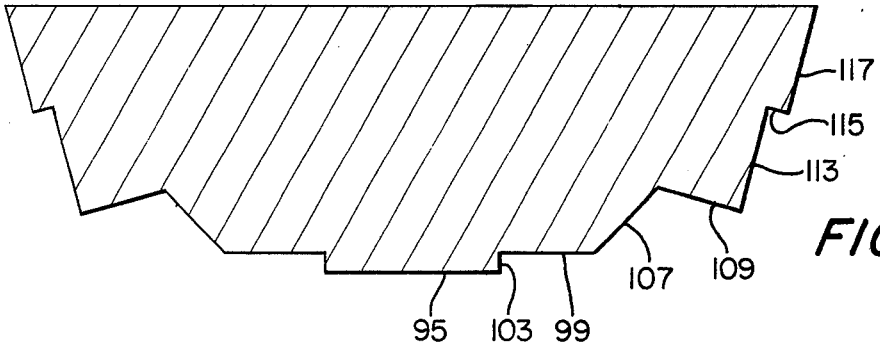
FIG. 8 is a cross-sectional view of the main mold of FIG. 5 taken along line 8—8 of that figure.
Figure 9:
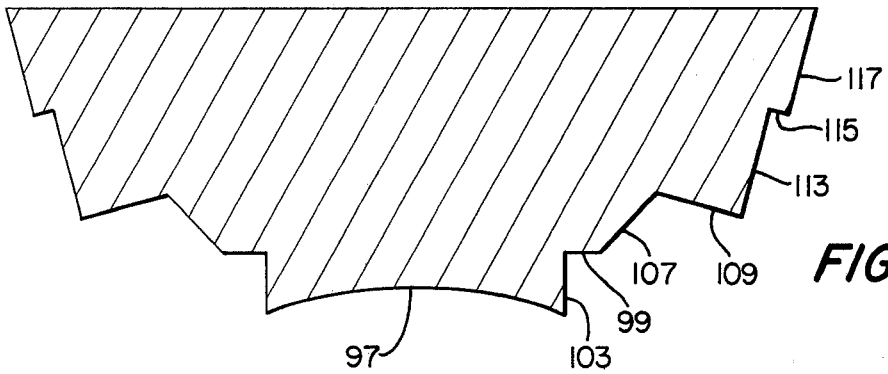
FIG. 9 is a cross-sectional view of the main mold of FIG. 5 taken along line 9—9 of that figure.

FIG. 6 shows a rear view of this same embodiment clearly identifying rear fin 59. Fin 59 is disposed at the rear of flotation ski 43 so as to clear away any snow spillover caused by the displacement of track-forming assembly 42, thus keeping the newly formed ski track clear of snow. As seen in FIGS. 4, 5 and 6, each fin 59 is wedge-shaped and canted so that the end thereof at the inboard side of the ski is higher and leads the end thereof at the outboard side of the ski which is lower.

Figure 10:
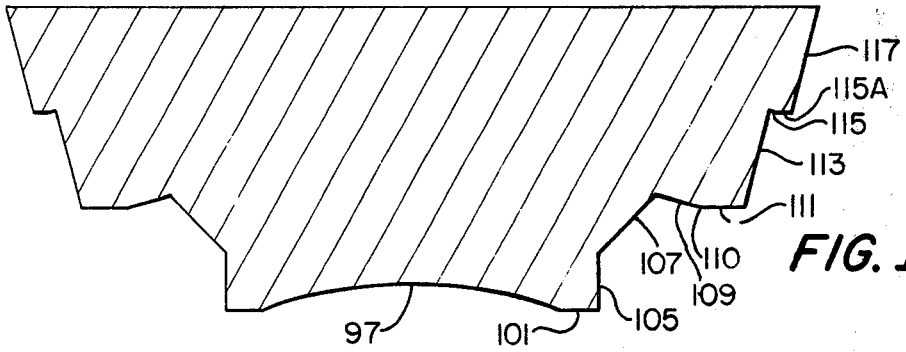
FIG. 10 is a cross-sectional view of the main mold of FIG. 5 taken along line 10—10 of that figure.

FIG. 10 shows a cross-sectional view of the ski tracks formed by track-forming assemblies 42 already described. It is desired for both racing and general recreational skiing and is composed of a plurality of surfaces and edges which are hereinafter described in greater detail.

The base of each ski track comprises a convex surface 119 in conjunction with a pair of identical side grooves 121. This unique construction allows for better contact between ski track and ski bottom and is designed to accommodate any stray snow which may enter the ski track so as to render it harmless, thereby assuring greater track life and superior track performance. Intersecting side grooves 121 at an angle of 90° each are a pair of opposed vertical side walls 123. These walls are of sufficient dimensions to accommodate a standard Nordic ski 139, as shown, and lead to a pair of receding edges 125 set at a 45° angle from vertical side walls 123. Receding edges 125 are angled to allow the ski to meet a sufficiently strong track which won't break up easily during passage of the ski. Receding edges 125 join a pair of inclined surfaces 127. Rising upwards from surfaces 127 are a pair of edges 129 angled at approximately 75° off horizontal and reaching a pair of narrow inclined ledges 131 that are parallel to surfaces 127. The latter are sufficiently wide so as to accommodate the width of a typical Nordic ski binding and/or ski boot between them. Rising upwards from ledges 131 are a pair of edges 133 which lie parallel to edges 129. These extend up to horizontal surfaces 135. Surfaces 135 lie above the normal snow surface and provide protection against drifting snow and wind erosion. Horizontal surfaces 135 extend to a pair of grooves 137 formed in the snow by edge compression fins 67. The horizontal surfaces 111 and 115A provide relief from the snow compression produced by surfaces 109 and 115 and also prevent possible damage to the molded ski track as a consequence of the rear end of the mold tending to shift laterally as the track-forming assemblies are caused to follow a turning path.

ADVANTAGES OF THE PRESENT INVENTION

These are numerous advantages to using this invention instead of conventional track sleds. First, a ski track is produced which has a track plane perpendicular to the earth's radius on all types of terrain rather than one which may vary with the slope of the land. This leads to increased skier stability and thereby allows faster skiing with less fatigue. Second, the track sled produces a ski track which removes the need for ski-in. Third, the ski track is provided with a convex bottom surface to allow better contact between ski bottom and track. Fourth, the ski track has a pair of grooves at its base to accommodate any stray snow which may enter the track, thereby rendering it harmless. Fifth, the ski track has much stronger surfaces molded from snow crystal aggregate using controlled distribution and advanced snow compression techniques. This leads to longer track life. Sixth, the ski track is surrounded by high ridges rising above the height of surrounding snow so as to act as a barrier against drifting snow. Seventh, the track sled is provided with shears to break up ice and hard snow and a front plow designed to work in conjunction with these shears so as to produce a better snow crystal aggregate from which the ski track is constructed.

MODIFICATIONS OF THE PREFERRED EMBODIMENTS

Figure 11:
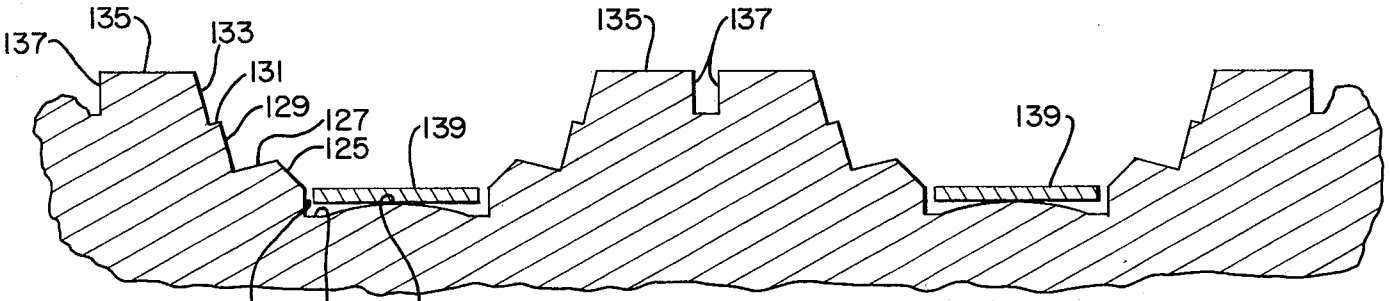
FIG. 11 is a cross-sectional view of a preferred embodiment of a Nordic ski track made in accordance with this invention.
Figure 12:
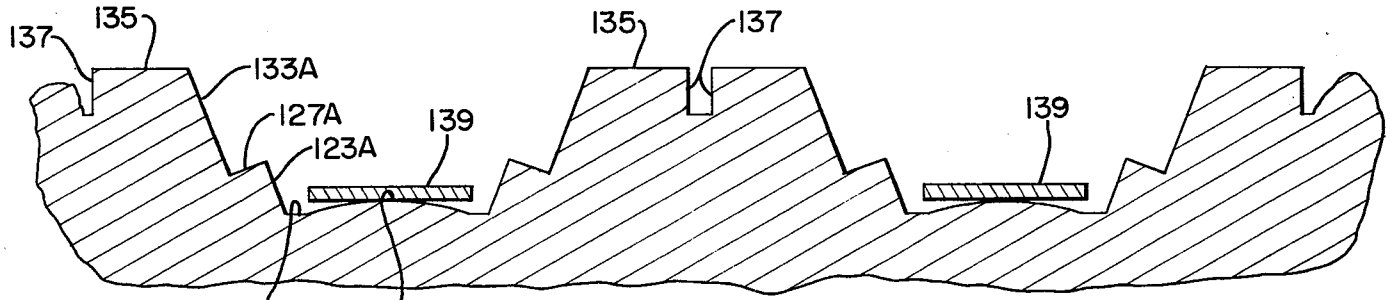
FIG. 12 is a cross-sectional view of a second embodiment of a Nordic ski track made in accordance with this invention.

Finally, it should be noted that the preferred embodiments illustrated and described herein are intended solely for the sake of example and clarity and are to be in no way construed as limiting the scope of the present invention, since various alterations may be carried out on the illustrated embodiments without departing from the essential features of the invention. Thus, for example, one might alter the design of snow mold 57 so that it leaves a different track profile. One such ski track embodiment is shown in cross-section in FIG. 11 where the side grooves 121 are intersected by opposite side walls 123A which extend at an angle of about 20° removed from the vertical and terminate at inclined surfaces 127A. The latter in turn intersect upper side walls 133A which are parallel to side walls 123A.

One also might modify towing member 50 from its Y-shape to some other configuration. Also contemplated is providing a frame 3 which is constructed from a single solid sheet of material rather than being hollow as described herein. Furthermore, one might provide a track-forming assembly 42 which completely omits ice shear assembly 55 or side edge compression fins 67. Also contemplated is that the rear ends of the transport skiis may be curved upwardly so as to allow the sled to be towed in reverse and modifying the mode of attaching the tension springs 77 so as to permit increasing or decreasing the tension to which they are subjected when the shears are in cutting position.

These and other changes of their type are foreseen as readily obvious to one skilled in the art.

What is claimed is:

1. A track sled comprising:

(1) a frame;

(2) transporting means attached to said frame for transporting said track sled through snow along a selected ski path;

(3) track-forming means for forming two parallel ski tracks of predetermined character along said ski path, wherein said track-forming means comprises two substantially identical tracking-forming assemblies mounted parallel to one another;

(4) means for attaching said track-forming assemblies to said frame so that each of said track-forming assemblies is capable of rotating freely about an axis which extends longitudinally of said frame, whereby each of said track-forming assemblies is capable of forming said ski tracks with a bottom plane substantially perpendicular to the earth's gravitational force;

(5) means for coupling said track sled to a suitable transport; and (6) means for providing relative vertical movement between said track-forming means and said transporting means so as to alternately (a) elevate said track-forming means above said transporting means so that said sled can be transported through snow without forming said ski track, and (b) lower said track-forming means in position to form a ski track as the sled is transported along a ski path.

2. A track sled according to claim 1 wherein said frame comprises fore and aft end members and said track-forming means is attached to said fore and aft members.

3. A track sled according to claim 1 wherein each of said track-forming assemblies comprises a flotation ski for support, neans for cutting through ice and hard snow, and a snow mold.

4. A track sled according to claim 3 wherein said means for cutting through snow and ice comprises at least one ice shear yieldably mounted on and protruding through the bottom of said flotation ski.

5. A track sled according to claim 4 wherein said at least one ice shear is disposed at the front end of said flotation ski.

6. A track sled according to claim 4 further including a tension device for holding said ice shear in cutting position.

7. A track sled according to claim 3 wherein said snow mold comprises a front plow for pushing aside snow and ice particles, a trailing member for drawing said snow and ice particles back into molding position, and a main mold for shaping said snow and ice particles into a desired track shape.

8. A track sled according to claim 7 wherein said main mold comprises a block containing a plurality of side edges and surfaces for forming a ski track of desired characteristics.

9. A track sled according to claim 8 wherein said main mold is shaped to form a ski track which comprises a convex bottom surface, a bottom section which includes said bottom surface for accommodating the width of a ski, and a wider upper section for accommodating the width of a ski binding.

10. A track sled according to claim 1 wherein said transporting means comprises a pair of transport ski hung outboard of said frame and said track-forming means.

11. A track sled according to claim 1 wherein said means for providing relative vertical movement comprises a lever for raising and lowering said frame relative to said transporting means.

12. A track sled comprising:

(1) a frame;

(2) transporting means attached to said frame for transporting said track sled through snow along a selected ski path;

(3) track-forming means attached to said frame for forming a ski track of predetermined cross-section along said ski path, said track-forming means comprising a pair of flotation skis and a snow mold attached to the underside of each of said flotation skis, said snow mold having a stepped configuration along each of its opposite longitudinally-extending sides and a substantially concave bottom surface; and (4) means for providing relative vertical movement between said transport means and said track-forming means so as to alternately (a) elevate said snow mold above said transporting means so that said sled can be transported through snow without forming said ski track and (b) lower said snow mold in position to form a ski track as said sled is transported along a ski path.

13. A track sled according to claim 12 wherein each of said flotation ski is capable of rotating freely about an axis which extends longitudinally of said frame.

14. A track sled according to claim 12 wherein said snow mold comprises a front plow for pushing aside snow and ice particles, a trailing member for drawing said snow and ice particles back into molding position, and a main mold for shaping said snow and ice particles into a desired track shape.

15. A track sled according to claim 14 wherein said snow mold comprises in longitudinal profile a recess which trails and is adjacent to said trailing member, and precedes and is adjacent to said main mold.

* * * * *

UNITED STATES PATENT AND TRADEMARK OFFICE

CERTIFICATE OF CORRECTION

PATENT NO. : 4122614

DATED : October 31, 1978

INVENTOR(S) : Stanley O. Cheney

It is certified that error appears in the above–identified patent and that said Letters Patent are hereby corrected as shown below:

Column 10,line 62, claim 10, "ski" should be "skis".

Column 12, line 6, claim 13, "ski" should be "skis".

Signed and Sealed this

*Sixth* Day of *February 1979*

[SEAL]

*Attest:*

RUTH C. MASON
*Attesting Officer*

DONALD W. BANNER
*Commissioner of Patents and Trademarks*